United States Patent [19]

Christensen et al.

[11] 4,452,694

[45] Jun. 5, 1984

[54] APPARATUS FOR SELECTIVE SORTING OF MATERIAL CHIPS

[75] Inventors: Elmer Christensen, Kirkland; Frank J. Steffes, Camas, both of Wash.

[73] Assignee: Black Clawson, Inc., Everett, Wash.

[21] Appl. No.: 202,101

[22] Filed: Oct. 30, 1980

Related U.S. Application Data

[63] Continuation of Ser. No. 777,898, Mar. 16, 1977, abandoned.

[51] Int. Cl.[3] ..... B07B 13/04

[52] U.S. Cl. ..... 209/672; 209/361; 209/667

[58] Field of Search ..... 209/671, 672, 615, 616, 209/621, 673, 659, 660, 667, 668, 684, 685, 701, 361, 233

[56] References Cited

U.S. PATENT DOCUMENTS

| | | | |
|---|---|---|---|
| 622,035 | 3/1899 | Bray | 209/672 |
| 631,093 | 8/1899 | Richards et al. | 209/672 |
| 1,418,899 | 6/1922 | Acken | 209/672 |
| 1,677,838 | 7/1928 | Molin | 209/672 |
| 2,257,352 | 9/1941 | Silver | 209/672 |
| 3,265,206 | 8/1966 | Allen | 209/672 |
| 3,985,233 | 10/1976 | Sherman | 209/671 |
| 4,037,723 | 7/1977 | Wahl et al. | 209/671 |

*Primary Examiner*—Randolph Reese
*Assistant Examiner*—Donald Hajec
*Attorney, Agent, or Firm*—Biebel, French & Nauman

[57] ABSTRACT

Apparatus for selectively sorting pulp wood chips in accordance with a predetermined maximum thickness includes a plurality of disk members disposed in a plurality of separately rotatable rows, with each row having a plurality of the members disposed in spaced parallel vertical planes, and with members in adjacent rows intermeshing with equal spaces therebetween. Each disk member has a radially contoured outer periphery with the depth of the contour being sufficiently shallow to prevent chips of thickness greater than the predetermined maximum from passing between its outer peripheral edge and an opposing spacer mounted between disk members on an adjacent row. All the rows of disk members are driven in the same direction, but adjacent disks are preferably driven at different peripheral speeds.

11 Claims, 17 Drawing Figures

APPARATUS FOR SELECTIVE SORTING OF MATERIAL CHIPS

This is a continuation of application Ser. No. 777,898 filed Mar. 16, 1977, now abandoned.

BACKGROUND OF THE INVENTION

1. Field of the Invention

The present invention relates to sorting devices and more particularly, to sorting devices for wood chips according to their thickness, to be used in the production of paper pulp.

2. Prior Art

The great majority of devices used for sorting varying sizes for material chips generally utilize screens having an appropriate mesh that will permit chips smaller than certain dimensions in thickness, length and width to pass through the screen and be collected, while the rejected material passes over the screen for subsequent disposal.

Other prior apparatus for this purpose utilizes a plurality of equal diameter disks disposed in a plurality of rows, over which the material to be sorted is fed. The disks rotate in the same direction, which causes the material to progress along the sorting device. Such devices are intended primarily for a gross separation of chunky or elongated over sized chips from materials of a generally smaller size. The acceptable smaller sized chips pass between the disks relatively easily, while the over sized chips are held back by the disks and carried to the discharger. Long thin pieces which would be acceptable except for their length, because they are longer than the distance between disks, are transported crosswise to the direction of flow of the other chips to the discharge end of the apparatus.

When using such a device for gross sorting of wood chips, it is thus necessary that the material not be upset too much or the longer thin pieces will pass through the disks and contaminate the acceptable chips being collected. The disks are therefore of uniform diameter so that the chips will be horizontally transported along the device.

A further disadvantage associated with this latter type of prior art device is that when disks having a smooth outer peripheral edge are used, the material chips being sorted tend to slide over the disks and not be gripped thereby, and are therefore not as efficiently sorted as is desirable, which results in a substantial loss of otherwise usable material chips that remain with the rejected chips and are disposed of.

Another disadvantage associated with these prior art devices is that when some form of member having other than a circular disk shape is utilized, for example a star-shaped or other convoluted periphery, these members in adjacent rows are arranged to mesh with each other like gears while rotating at the same peripheral speeds in order to avoid upsetting the oversized chips and thereby interrupting their orderly travel along the tops of successive rows of disks, but this also results in carrying to the reject outlet a good number of chips which would be accepted if upset to present a different dimension to the spaces between adjacent disks.

SUMMARY OF THE INVENTION

The present invention overcomes the above described difficulties and disadvantages associated with prior art devices by providing a material chip thickness sorting apparatus which not only sorts chips of acceptable thickness of small enough width and length to pass between adjacent disks, but upends long chips of the desired thickness so that they too will be separated into the accepted material.

The apparatus of the invention utilizes a plurality of parallel rows of disk members with the disks in each row disposed in spaced parallel vertical relation along a common horizontal central axis of rotation. The disks of adjacent rows intermesh radially with equal axial spaces between them to permit chips of no greater thickness than such space to pass downwardly between the overlapping disk surfaces, the width of this space being controlled to correspond with the maximum desired thickness of accepted chips. In addition, provision is made to provide no greater space between the edge of each disk member and the radially closest portion of the adjacent row or rows than the space between intermeshing disks, for example by means of spacers between adjacent disks on a common shaft.

The chips to be sorted are fed into the apparatus above the first of the rows of the disks. The material leaving the infeed will then be transported over the disks, with chips whose thickness is less than the width of the space between adjacent intermeshing disks dropping therebetween. The remaining thicker chips are transported to the last of the rows of disks and dropped onto an output device for removal from the apparatus.

It is important to the practice of the invention that adequate provision be made to develop forces tending to align the traveling chips lengthwise with the disks and also to upset them so that they present their thicknesses to the spaces between adjacent intermeshing disks. A particularly effective way of accomplishing this result is to cause adjacent disks to rotate at different peripheral speeds. One preferred form of the invention for this purpose has the disks in each row of alternating diameters, e.g. a two-inch variation, so that even if all rows are driven at the same angular rate, both aligned and intermeshing disks will rotate at different peripheral speeds.

In another form of the invention, the desired difference in peripheral speeds of adjacent disks is accomplished by having the disks in each row of a different common diameter from those in the adjacent row or rows, and to drive all rows at the same angular rate. The resulted repeated changes in the rate of forward movement of the chips along the tops of the disks, and in their vertical inclinations as they pass from disks of one diameter to those of another diameter, are effective in upsetting the chips to present them in the appropriate alignment for passage between intermeshing disks if they are within the acceptable thickness range.

As an alternative form disks of uniform diameter can be used, in which case adjacent rows should be driven at different angular rates to produce different peripheral speeds of disks in adjacent rows. Other arrangements of disks and spacers in accordance with the invention are described in detail hereinafter. In every case, each disk has a radially contoured outer peripheral edge portion, with the depth of the contour sufficiently shallow to prevent chips of thickness greater than the predetermined thickness from passing between the outer peripheral edge of a member and an opposing spacer, the purpose of the contoured disk periphery being to avoid smooth cylindrical edges which will have minimum frictional or gripping engagement with the chips.

The contoured peripheries of the disks provide a gripping action facilitating transport of the chips across the tops of the rows of disk members, and a plurality of forms of disk peripheries are provided by the present invention. One preferred form has a contour formed of a plurality of blending alternately reversed radii in the plane of the disk, with the radii being sufficiently small that chips of greater than the desired thickness will not pass between the outer peripheral contoured edge portion of a disk and an opposed spacer.

An alternative form of disk periphery has a contour defining a plurality of spaced, substantially semi-circular recesses in the plane of the disk with the depth of the semi-circular recesses being limited as with the radii mentioned above. A further alternative construction is a peripheral contour formed of a plurality of generally triangular tooth-like protrusions in the plane of the disk with the depth between protrusions being limited as with the radii mentioned above.

A still further alternative disk construction has a peripheral contour formed of a plurality of wave-like projections having a radiused leading edge portion in the direction of rotation of the disk and a generally flat portion extending radially inward toward the bottom of the radiused portion of the rearwardly adjacent projection and formed in the plane of the disk with the depth of the contour being limited as aforementioned.

Many other forms of the peripheral contour of the disks are possible, so long as the depth of the contour is such that it will prevent chips of greater than the desired thickness from passing between the edge of a disk and an opposed spacer. In addition, the pattern of different peripheral speeds of adjacent disks is preferably such that the longer chips of acceptable thickness will be oriented parallel to the flow of material over the disks rather than crosswise as with prior art devices. This assists in the up-ending of such long chips so that they can more easily pass between the disks.

A further advantage of the present invention over such mentioned prior art devices is in the possibility of an alternate construction in which rows of the disks are provided in an inclined plane rather than in a horizontal plane as is contemplated as one alternative embodiment of the present invention. The inclined plane may be either upwardly or downwardly inclined relative to the infeed and outfeed mechanisms, so that the rate of material feed may be increased or decreased as desired.

In addition to the use of an inclined plane, it is contemplated, as a further alternative, to use a cascading arrangement of the rows of disks wherein a plurality of rows would be in a horizontal plane adjacent the infeed mechanism, a further plurality of rows would be downwardly inclined and subsequently disposed adjacent the first set of horizontally disposed rows, and a third plurality of rows would be horizontally disposed subsequent to the inclined rows and leading to the output mechanism. This would produce a variable rate of material flow which would assist in up-ending or otherwise reorienting the chips so that those of the desired thickness would pass between the disks of the device.

Before proceeding to a description of the preferred embodiments of the invention, it should be noted that while the apparatus of the invention was developed essentially for the sorting of wood chips for use in the manufacture of paper pulp, it is applicable to the sorting of chips of other materials in accordance with thickness, and is particularly applicable to such chips which are of a substantial range of length and width dimensions. Accordingly, references herein to "chips" are to be understood as correspondingly comprehensive and not limited to wood chips.

DETAILED DESCRIPTION OF THE PREFERRED EMBODIMENTS

Figure 1:
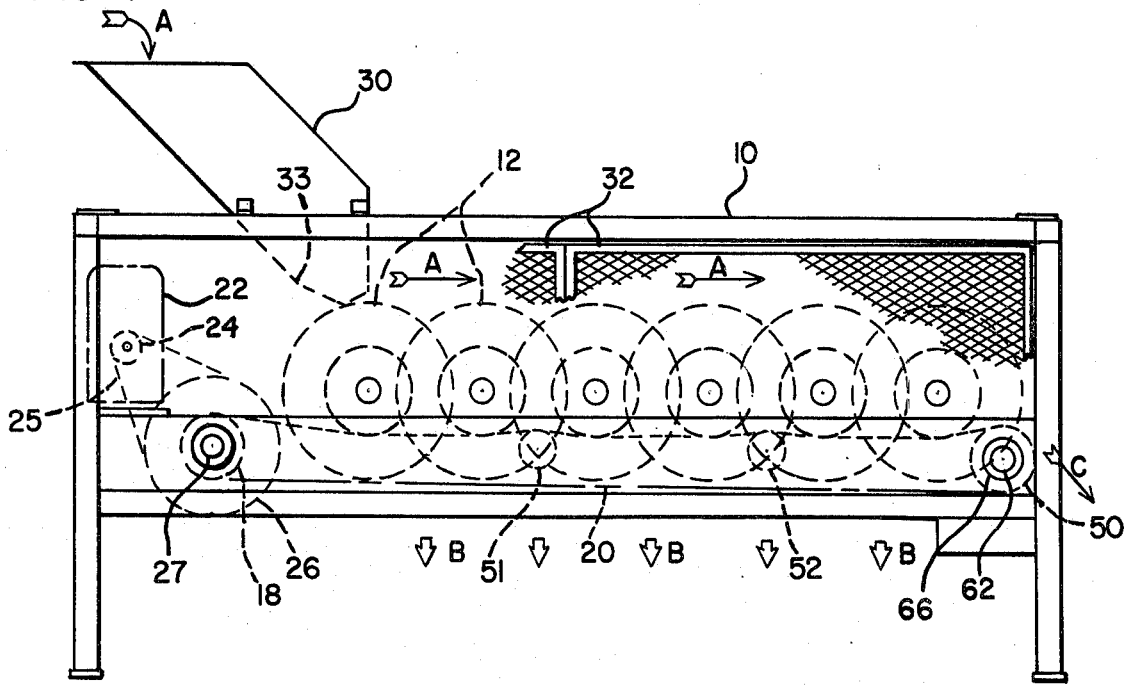
FIG. 1 is a side elevational view of a preferred embodiment of the present invention.
Figure 2:
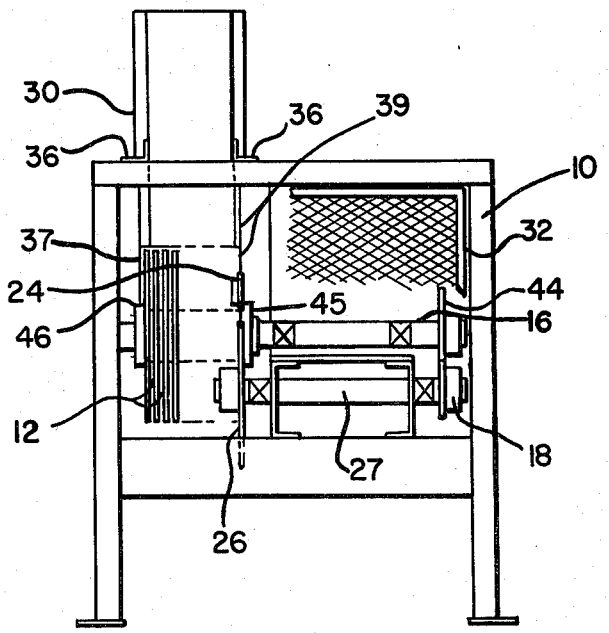
FIG. 2 is a rear elevational view of the embodiment of FIG. 1.
Figure 3:
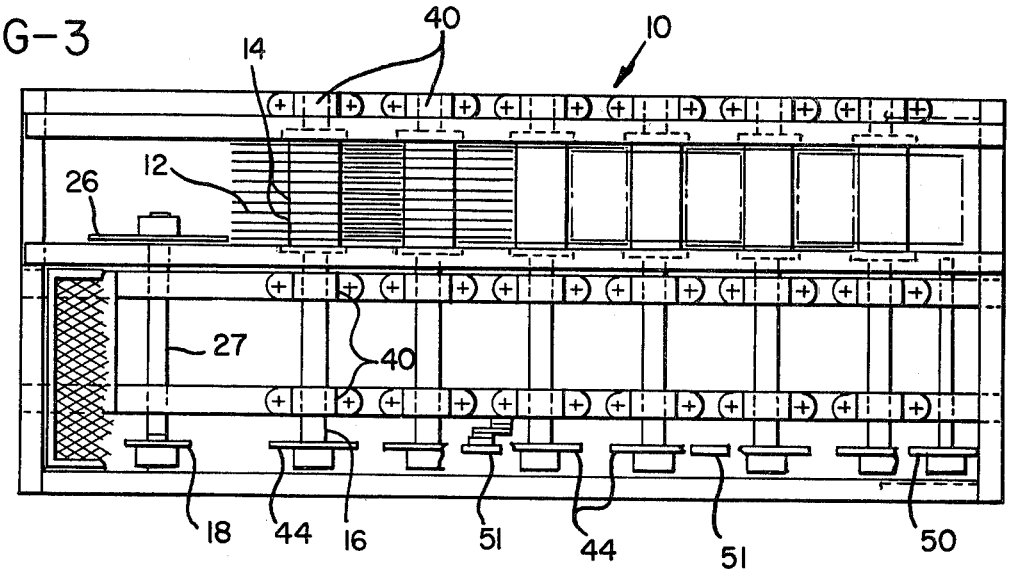
FIG. 3 is a partially cut away top plan view of the embodiment of FIG. 1.

Referring to FIGS. 1–3, the basic construction of the apparatus of the present invention includes a frame structure 10 and a plurality of disk members 12 with spacers 14 mounted between the disks, all of which are secured for rotation to a plurality of drive shafts 16 rotatably supported in the frame structure 10. The drive shafts 16 are driven by a chain 20 through a sprocket 18 which in turn is driven by motor 22 via sprocket 24, chain 25 and a sprocket 26 on the same shaft 27 as sprocket 18.

Above the first row of disks 12 is an infeed chute 30 through which the chips to be sorted are introduced into the apparatus. Arrows A show the direction of flow of the material chips to be sorted, arrows B show the direction of flow of chips of the desired size which have fallen between the disks 12, and arrow C shows the direction of flow of the discarded chips which are thicker than desired.

The frame structure 10 is basically of tubular steel construction made sufficiently strong to carry the weight of the apparatus as well as the load of the material chips being sorted. Safety screens 32 are preferably removably secured to the sides and ends of the apparatus, over that portion which houses the drive mechanism, so as to prevent possible injury to individuals working around the apparatus. The screens 32 are removable so that the drive mechanism of the apparatus may be serviced.

The infeed chute 30 is preferably made of sheet metal constructed to produce a chute having a rectangular cross section but which is radiused at the bottom portion 33 so that the chips are introduced at a tangent to the first row of disks 12. The infeed chute 30 is preferably secured to the top of the frame structure 10 such as by means of brackets 36 bolted to the frame structure and to the infeed chute. Sheet metal can also be used to provide sides 37 and 39 on each side of the disks 12, to provide a guide for the material chips from the infeed to the discharge.

All of the drive shafts 16 which support the disks 12 are rotatably supported in the frame structure 10, by bearings 40 which are in turn supported on suitable parts of the frame structure 10. At one end of each drive shaft 16 is a sprocket 44 which is in driven engagement with chain 20. At the opposite end of each drive shaft 16, a plurality of alternating disks 12 and spacers 14 are clamped between a shoulder 45 on the shaft and a nut 46 threaded on the end of the shaft inboard of the adjacent bearing 40.

As stated above, all of the sprockets 44 are in driven engagement with chain 20, which extends between drive sprocket 18 and follower sprocket 50. In addition, two idler sprockets 51 and 52 are provided to maintain appropriate driving engagement of the chain 20 with the sprocket 44 on each drive shaft 16.

The drive motor 22 can be of any desired characteristics sufficient to provide the necessary power range for driving the disks 12 at the necessary rotational speeds for proper sorting of the material chips. By way of example only, in an apparatus constructed as shown in which six rows of generally disk members 12 of a diameter in the range of 15 to 17 inches, and with each row of disks approximately 12 inches long, a one-horsepower variable speed drive motor, which will vary the motor output drive shaft speed between 114 rpm and 1117 rpm, is satisfactory.

It is also desirable to be able to change the diameter of drive sprocket 24, and thus the drive shaft of the motor should be provided with some means for changing this sprocket as well. In general, a speed range of 20 to 40 rpm for the disk shaft 16 has been found satisfactory.

Figure 4:
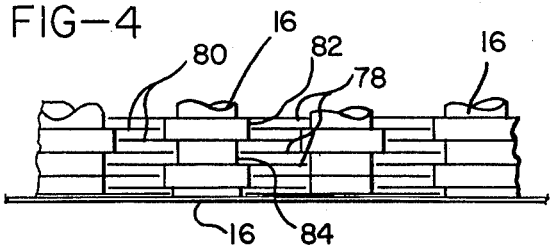
FIG. 4 is a top plan view of an alternative construction of the disk members and opposed spacers of the invention.
Figure 8:
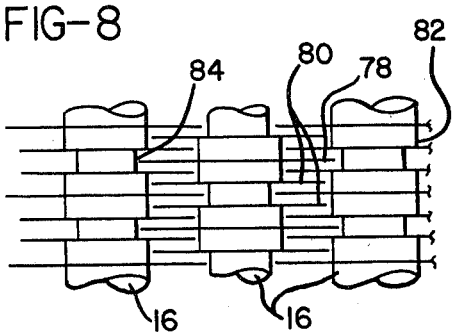
FIG. 8 is a top plan view of a third alternative arrangement of the disk members of the invention.

Referring now to FIG. 8, a variety of disk members 12 and spacers 14 are contemplated for use with the present invention, the preferred ones of which are shown in these figures. FIG. 4 illustrates one such pattern in which a series of first disk members 78 of relatively large diameter are disposed on drive shafts 16 with alternatively positioned relatively smaller diameter disk members 80, all of which are separated by relatively larger and smaller diameter spacers 82 and 84, respectively.

This construction provides each row of disks with a pattern of alternately relatively larger and smaller disks which intermesh with an adjacent row of disks so that in the apparatus, there will be alternate pairs of adjacent equal diameter intermeshing disks of larger and smaller diameter, while on each row there will be a repeating pattern of larger and smaller diameter disks.

The spacers 82 and 84 have outer diameters such that the distance from the edge of either size disk to the edge of the opposing spacer will be not greater than the distance between adjacent intermeshing disks. That is, in the case of a relatively larger disk 78, the corresponding opposed spacer 84 will be of a relatively smaller diameter than spacer 82, so that the distance between the outer peripheral edge of disk 78 and spacer 84 is not greater than the distance between two adjacent intermeshing disks.

Figure 5:
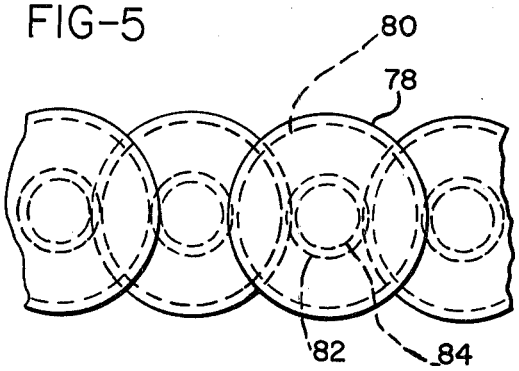
FIG. 5 is a front elevational view of the disk member arrangement shown in FIG. 4.

The preferred relative diameters of this disk pattern is best seen in FIG. 5. For example, where the larger disks 78 are approximately 17 inches in diameter, it is advantageous to utilize relatively smaller disks 80 of a diameter of 15 inches. These dimensions, however, should not be considered as limiting, and substantial variations in the relative dimensions can be made without detracting from the advantages of the invention.

Referring to another pattern which may be utilized in the present invention, FIG. 6 again illustrates the use of two different diameter disk members 78 and 80, but in this variation all of the disks on any given drive shaft 16 are of the same diameter, while the adjacent shaft or shafts will contain either the larger or smaller diameter disks. This pattern provides adjacent intermeshing disks which are alternately larger or smaller, while on any given row the disks are of the same diameter.

A third variation of disk pattern is illustrated in FIG. 8, wherein the pattern of disk members in each row is such that a single, relatively larger diameter disk 78 is followed by two relatively smaller diameter disks 80, with this pattern being repeated for the width of the disposition of the disks on the drive shaft. Adjacent drive shafts have the same pattern, but are staggered so that a larger diameter disk 78 is disposed between smaller diameter disks 80 on an adjacent drive shaft. The spacers 82 and 84 are so arranged that they correspond with the smaller disks 80 and larger disks 78, respectively. The spacing between the peripheral edge portion of each disk and the opposing spacer should not be greater than the distance between adjacent intermeshing disks.

Figure 6:
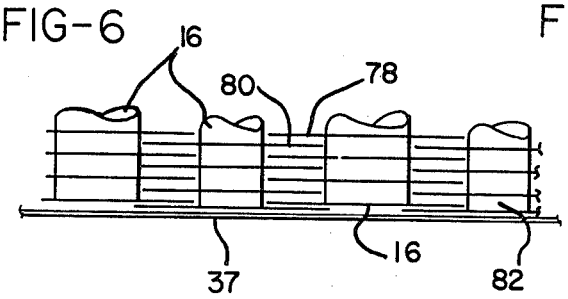
FIG. 6 is a top plan view of a second alternative arrangement of the disk members of the invention.
Figure 7:
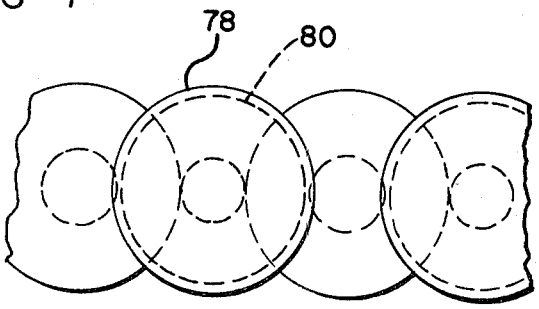
FIG. 7 is a front elevational view of the disk member arrangment shown in FIG. 6.

It will be noted in FIGS. 4, 6 and 8 that above each of the spacers 14 there is a sort of pocket, which is about approximately twice as wide in axial extent as the space between intermeshing disks 12 and as long in the direction parallel with the disks as the diameter of the particular spacer. These pockets, however, cause no problem in operation, nor do they interfere with the desired results of the apparatus, as now described.

Chips do drop into these pockets, but they cannot move further downwardly unless they are within the desired thickness range for acceptance between intermeshing disks. Chips of greater thickness which drop into a pocket will remain there only temporarily. Sooner or later, additional chips will drop into the same pocket until several will become wedged together and thrown clear, apparently by being picked up by the upwardly moving trailing edge portion of the disk in the next forward row which adjoins the pocket.

Figure 9:
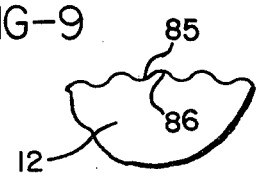
FIG. 9 is an illustration of a fragment of a preferred contoured edge portion of the disk members of the invention.

The novel contoured edge portions of the disk members of the present invention are basically illustrated in FIGS. 9–12. One design for a contoured edge portion is illustrated in FIG. 9 in which a quadrant of the contoured edge portion of the disk member 12 is illustrated as formed of a plurality of blending alternately reversed semicircular portions 85 and 86 in the plane of the disk.

Figure 10:
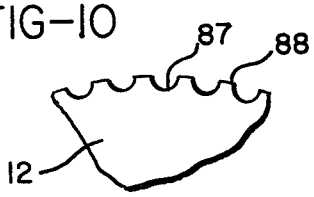
FIG. 10 is an illustration of a fragment of a second preferred form of contoured edge portion of the disk members of the invention.

A second variation of the outer peripheral contour of each disk member 12 is illustrated in FIG. 10 in which the edge is formed of a plurality of spaced substantially semi-circular recesses 87, producing spaced lands 88 between them, also in the plane of the disk.

Figure 11:
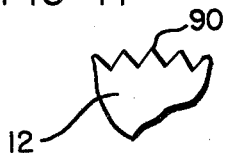
FIG. 11 is an illustration of a third contoured edge portion of disk members of the invention.

A third alternative form of the outer peripheral contour of a disk member is shown in FIG. 11 in which the outer edge is formed of a plurality of triangularly shaped tooth-like protrusions 90 in the plane of the disk 12.

Figure 12:
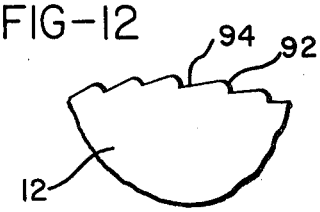
FIG. 12 is an illustration of a fourth alternative construction of the edge portion of a disk member of the invention.

A fourth variation of the contour of the outer peripheral edge of each disk member is shown in FIG. 12, in which it is formed of a plurality of wave-like projections each having a radiused leading edge portion 92 in the direction of rotation of the disk-shaped member and a generally flat portion 94 extending radially inward toward the bottom of the radiused portion 92 of the rearwardly adjacent projection, and being formed in the plane of the disk.

The depth of the contour on the edge of any of the above disk members should not be any greater than that which will permit chips of the desired maximum thickness to pass between the edge of the member and an opposing spacer. The exact depth for any given contour configuration and thickness of chip to be sorted can best be determined experimentally so that the combined effect of depth, pitch and peripheral speed is such that overthick chips cannot go through in this area. For example, an arrangement which has proven satisfactory is a disk with a 17 inch diameter having a contoured edge portion of adjacent reversed radii with a distance between centers of 7.5 degrees with a depth variation of 0.24 inch.

Figure 13:
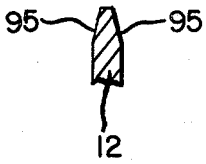
FIG. 13 is a partial cross sectional view of the contoured edge portion of a disk member of the invention showing a doubled edge portion.

In addition, all of the configurations of contoured edge portions of disk members illustrated in FIGS. 9–12 may have beveled edge portions in cross section, as illustrated at 95 in FIG. 13, or may be flat sided, whichever is desired.

Figure 14:
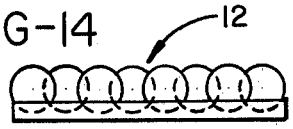
FIG. 14 is a schematic view showing the horizontal positioning of a plurality of rows of disk members of the invention.

In addition to varying the design of the contoured outer edge portion of the disk members in order to assist in the gripping of the chips being sorted, it is contemplated that variations in the positioning of the rows of the disks can be utilized to effect the material flow across the top of the disks. One such position is illustrated in FIG. 14, which corresponds to the position of the disks 12, as illustrated in FIG. 1. This positioning produces an essentially horizontal plane in which the chips to be sorted will flow in the direction indicated by the arrows A in FIG. 1.

Figure 15:
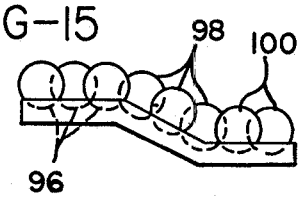
FIG. 15 is a schematic view showing a cascading plurality of rows of disk members of the invention.

A second contemplated positioning of the rows of disks 12 is illustrated in FIG. 15, in which a cascading effect is utilized wherein a plurality of rows 96 of disk members adjacent the infeed chute are in essentially a horizontal plane, a second adjacent set of rows 98 of disk members is inclined downwardly relative to the first set of rows, and a third set of rows 100 of disk members is again disposed in a horizontal plane, leading toward the reject output of the apparatus where the material is discharged. This will produce a variation in the material flow as it passes over the cascading portion of the material flow path which will assist in mixing the chips to be sorted, thus causing additional interaction that will up-end chips and expose them to the openings between adjacent disks so that those of the desired thickness range will pass vertically downward between the members and be collected.

Figure 16:
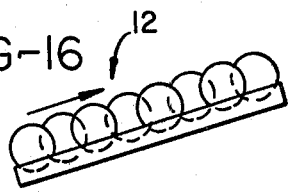
FIG. 16 is a schematic view illustrating an upwardly inclined row of disk members relative to the direction of flow of the material.

A third variation of positioning of rows of disks 12 is illustrated in FIG. 16, in which a material flow path is created in an upwardly inclined angle from the infeed chute, with the material flow as indicated by the arrow.

Figure 17:
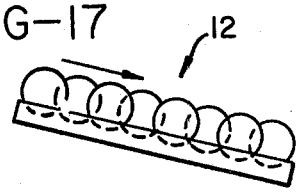
FIG. 17 is a schematic illustration of a plurality of rows of disk members inclined downwardly relative to the direction of flow of material.

A fourth variation of the positioning of rows of disk members is illustrated in FIG. 17, where an inclined plane of material flow is created extending downwardly from the infeed chute, with the material flow in the direction of the arrow. These last two variations will, respectively, effect a decrease and an increase in the rate of material flow across the top of the disks.

It is to be noted that although in the description above in connection with the variations in patterns for rows of disks, such as those illustrated in FIGS. 4–8, only uniform patterns were given. However, when using some of these patterns, some variations in the pattern will be necessary adjacent the side walls of the device in order to keep the proper spacing between adjacent disk-shaped members. For example, the pattern illustrated in FIG. 6 is varied along the side rail 37 so that a larger disk 78 is secured to the drive shaft 16 on which the remaining disks are the relatively smaller diameter disks 80.

A similar variation may exist on other pattern designs, where it is necessary to maintain the proper spacing between an outer peripheral edge portion of a disk and an opposed spacing member such that it will not be greater than the distance between adjacent intermeshing disks of the regular pattern, for the remainder of the rows.

Although the spacing of the disks can be of any desired distance between them so that a chip of any desired maximum size will be permitted to pass through, in the case of sorting of wood chips for use in producing paper pulp, for which this invention has particularly advantageous use, it is contemplated that the spacing between adjacent intermeshing disks will be nominally 7 millimeters. However, even in the use contemplated for the paper pulp industry, this may vary in the range of 3–12 millimeters or greater in order to accumulate a broader range of chips with a desirable thickness.

Although the foregoing illustrates the preferred embodiments of the present invention, other variations are possible. All such variations as would be obvious to one skilled in this art are intended to be included within the scope of the invention as defined by the following claims.

What is claimed is:

1. In chip sorting apparatus including a plurality of intermeshing rows of discs having opposing faces and contoured outer peripheries, spacers interposed between said faces of adjacent discs in each row and having outer peripheries disposed opposite the contoured outer peripheries of the discs of an adjacent row, whereby said discs in each row are spaced from each other by said spacers, the improvement comprising:

adjacent discs in each of said rows of discs are of different diameters, and adjacent spacers in each of said rows of discs are of different diameters, whereby each of said rows is comprised of alternating relatively large and small diameter discs separated by alternating relatively large and small diameter spacers.

2. Apparatus according to claim 1 wherein said radially contoured outer peripheries of said disc members are formed of a plurality of blending alternatively reversed arcuate portions.

3. Apparatus as defined in claim 1 wherein said drive shafts are disposed in a series of planes so as to produce a cascade-like effect on movement of material over said disk shaped members.

4. The apparatus of claim 1 wherein:

axes of rotation of said rows of discs lie in a plane inclined with respect to the horizontal.

5. The apparatus of claim 1 wherein:

said chip feeding means is positioned adjacent a lowermost row of said rows of discs lying in an inclined plane, whereby said chips flow turbulently upwardly of said rows of discs.

6. The apparatus of claim 1 wherein:

said chip feeding means is positioned adjacent the uppermost one of said rows of discs disposed in an inclined plane, whereby said chips flow turbulently downwardly across said rows of discs.

7. The apparatus of claim 1 wherein:

the radial depth of said radially contoured outer periphery is sufficiently shallow to prevent chips of a thickness greater than the maximum thickness from passing in any substantial quantity between said outer peripheries and radially closest portions of an adjacent row or rows.

8. The apparatus of claim 7 wherein:

said outer peripheries are formed of a plurality of blending alternately reversed semi-circular portions in the planes of said discs.

9. The apparatus of claim 7 wherein:

said outer peripheries of said discs are formed of a plurality of spaced, substantially semi-circular recesses in the planes of said discs.

10. The apparatus of claim 7 wherein:

said outer peripheries of said discs are formed of a plurality of triangularly shaped teeth in planes of said discs.

11. The apparatus of claim 7 wherein:

said outer peripheries of said discs are formed of a plurality of wave-like projections having radiused leading edges in the direction of rotation of said discs and generally flat portions extending radially inwardly toward the bottoms of said radiused portions of said rearwardly adjacent projections and formed in the planes of said discs.

* * * * *